US005803021A

United States Patent [19]

Rourke et al.

[11] Patent Number: 5,803,021

[45] Date of Patent: Sep. 8, 1998

[54] BOILER ACCESS DOOR CONSTRUCTION

[75] Inventors: Carol A. Rourke, East Windsor, Conn.; John W. Shelton, Pikeville, Tenn.; Morgan L. Wilt, Manchester, Conn.

[73] Assignee: Combustion Engineering, Inc., Windsor, Conn.

[21] Appl. No.: 320,346

[22] Filed: Oct. 11, 1994

[51] Int. Cl.[6] ..... F23M 7/04

[52] U.S. Cl. ..... 122/498; 432/250; 122/497; 110/173 R; 49/381; 292/241

[58] Field of Search ..... 122/497, 498, 122/510; 432/250; 110/173 R, 173 C, 176, 181; 49/381; 292/241, DIG. 69, 256.73

[56] References Cited

U.S. PATENT DOCUMENTS

| | | | |
|---|---|---|---|
| 2,804,855 | 9/1957 | Bergman | 122/498 |
| 3,390,486 | 7/1968 | Walters | 49/381 |
| 3,881,995 | 5/1975 | White, Jr. | 202/248 |
| 3,906,670 | 9/1975 | Burton | 49/381 |
| 4,883,002 | 11/1989 | Schuster | 432/250 |
| 5,067,278 | 11/1991 | Lyons | 292/241 |
| 5,158,043 | 10/1992 | Emsbo | 122/498 |
| 5,193,998 | 3/1993 | Hack et al. | 432/250 |
| 5,274,881 | 1/1994 | Derosa | 49/381 |
| 5,421,626 | 6/1995 | Glachet | 292/241 |

*Primary Examiner*—Henry A. Bennett
*Assistant Examiner*—Jiping Lu
*Attorney, Agent, or Firm*—Robert S. Smith

[57] ABSTRACT

Apparatus for selectively permitting access to the interior of a boiler and selectively closing off access to the interior of the boiler which includes a frame, a support plate, and a hinge. The hinge couples the support plate and the frame and allows pivotal movement of the support plate with respect to the frame. The apparatus also includes a door plate; and apparatus for coupling the support plate to the door plate. In some forms of the invention the apparatus for coupling comprises a plurality of studs fixed to one of the plates in generally parallel spaced relationship. The other of the plates may include a plurality of holes disposed in generally registered relationship to the studs and dimensioned for loose fitting engagement with the studs. The apparatus may also include apparatus for latching the support plate to the frame to prevent pivotal movement thereof with respect to the frame. The apparatus may also include apparatus for urging the door plate away from the support plate toward the frame.

5 Claims, 5 Drawing Sheets

BOILER ACCESS DOOR CONSTRUCTION

BACKGROUND OF THE INVENTION

The invention relates to boilers used in steam generation systems and particularly to door assemblies in such apparatus. While the invention will be described in terms of access door constructions such as that used for access to the interior of the steam generating apparatus by human beings, for movement of materials into and out of such apparatus and for inspection of such apparatus, the invention may be applicable to other forms of door constructions.

The prior art door constructions have not sealed as tightly as is desirable. Another problem with the conventional door is the manufacturing expense. More particularly, the conventional door is pressed out of sheet stock using a die. Thus, there is considerable tooling expense involved in manufacturing the prior art door construction.

The prior art access door constructions have typically required refractory bricks to separate the door from the interior of the boiler. A disadvantage of such refractory bricks is that the installation is time consuming and the removal is also time consuming. A hazard associated with the removal of the refractory bricks is that there is a danger of dislodging a brick and dropping it into the furnace where it may damage a component within the boiler.

This risk of damage to internal components is more apparent by considering the construction of the boiler. The boiler is often a large structure that is higher than a several story building. The access doors are often disposed at elevations that are several stories above the base of the boiler. Thus, if a refractory brick is accidentally dislodged at one of these access doors it may fall a considerable distance and may easily damage a component in the interior of the boiler. The damage may have enormous significance. The boiler is a very large capital investment that good business practice dictates must be operated and not remain idle. Thus, damage from a falling refractory brick may compromise such a business objective.

The prior art apparatus has often used insulating liners on the inside of the access door. The liner was typically cured in situ. The curing process is time consuming and the consequences of not properly curing the liner is ineffective insulation. Ineffective insulation leads to the liner slagging off and subsequent failure of the door. Because of operator economic demands to utilize the investment and system capacity demands, boilers have often been started before curing is complete. This often results in a need for replacement of the entire door and liner.

It is an object of the invention to provide a boiler access door construction which will sustain the temperatures commonly encountered in boilers.

Another object of the invention is to provide apparatus that will not require the use of materials that are cured after placement in the access door opening.

Still another object of the invention is to provide apparatus that will not require the use of refractory bricks although the invention may be used with refractory bricks if the operator of the equipment desires to do so.

Yet another object of the invention is to provide apparatus that may be retrofitted on existing boilers as well as installed on new boilers.

Still another object of the invention is to provide a door construction that will provide better sealing then known door constructions.

One other object of the invention is to provide a construction that will have a minimum of tooling expense and will be assembled from off-the-shelf components whenever possible.

Another object of the invention is to provide apparatus which may be installed very quickly even when being installed to retrofit an existing system.

An additional object of the invention is to provide a modular apparatus to facilitate adaptation to the range of temperature applications and to provide a design that will not be vulnerable to operator error in utilizing the correct module for the specific temperature conditions that exist at a particular location in the steam generation apparatus.

SUMMARY OF THE INVENTION

It has now been found that these and other objects of the invention may be attained in apparatus for selectively permitting access to the interior of an associated boiler and selectively closing off access to the interior of the associated boiler which includes a frame, a support plate, a hinge, the hinge coupling the support plate and the frame and allowing pivotal movement of the support plate with respect to the frame, a door plate; and means for coupling the support plate to the door plate.

In some forms of the invention the means for coupling comprises a plurality of studs fixed to one of the plates in generally parallel spaced relationship. The other of the plates may include a plurality of holes disposed in generally registered relationship to the studs. The holes may be dimensioned for loose fitting engagement with the studs. The apparatus may also include means for latching the support plate to the frame to prevent pivotal movement thereof with respect to the frame.

The apparatus may also include means for urging the door plate away from the support plate toward the frame and the door plate may have mounted thereon channel shaped reinforcements extending substantially around the entire peripheral extent thereof. The means for urging the door plate away from the support plate may include a threaded member and a wheel fixed to the threaded member and the support plate may include a threaded sleeve dimensioned and configured for engaging the threaded member whereby rotation of the threaded member moves the threaded member with respect to the door plate.

The threaded member has an axis and the axis is disposed in substantially perpendicular relationship to the door plate and the support plate in some forms of the invention. The means for coupling may comprise first and second straps each fixed to the door plate and extending around the support plate with the straps constraining relative movement of the support plate with respect to the door plate in other forms of the invention. In such other forms of the invention each of the straps include nubbins extending therefrom for constraining movement of the straps and the support plate.

In another form of the invention a boiler apparatus has a passageway leading intermediate the exterior of the boiler and the interior of the boiler. The improvement comprises a cast plug shaped body dimensioned and configured for insertion and removal from the passageway. The plug has a handle thereon to facilitate insertion and removal from the passageway. The plug is modular and comprises a first module and a second module in one form of the invention. In addition the modules are dimensioned and configured for snug fitting engagement in the passageway.

In some forms of the invention each of the modules has a cross section that is a trapezium. In other forms of the invention each of the modules has a generally stair step cross section.

These forms of the invention include means for selectively permitting access to the interior of an associated boiler and selectively closing off access to the interior of the associated boiler. This means comprises a frame, a support plate, and a hinge. The hinge coupling the support plate and the frame and allows pivotal movement of the support plate with respect to the frame in some forms of the invention. This form of the invention includes a door plate and means for coupling the support plate to the door plate. The means for coupling may comprise a plurality of studs fixed to one of the plates in generally parallel spaced relationship.

The other of the plates may include a plurality of holes disposed in generally registered relationship to the studs and the holes may include having the holes dimensioned for loose fitting engagement with the studs.

BRIEF DESCRIPTION OF THE DRAWINGS

The invention will be better understood by reference to the accompanying drawing in which.

DESCRIPTION OF THE PREFERRED EMBODIMENTS

Figure 2:
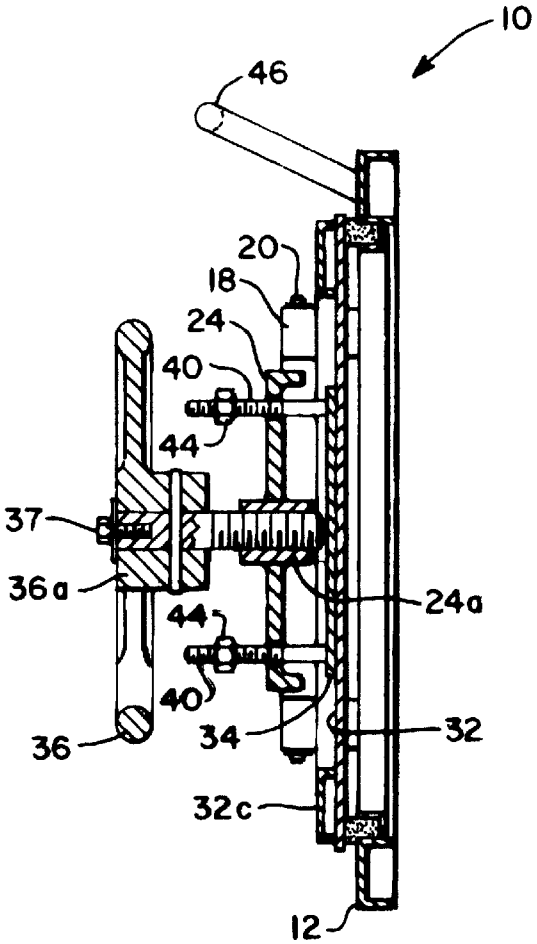
FIG. 2 is a right side elevational view of the door shown in FIG. 1
Figure 1:
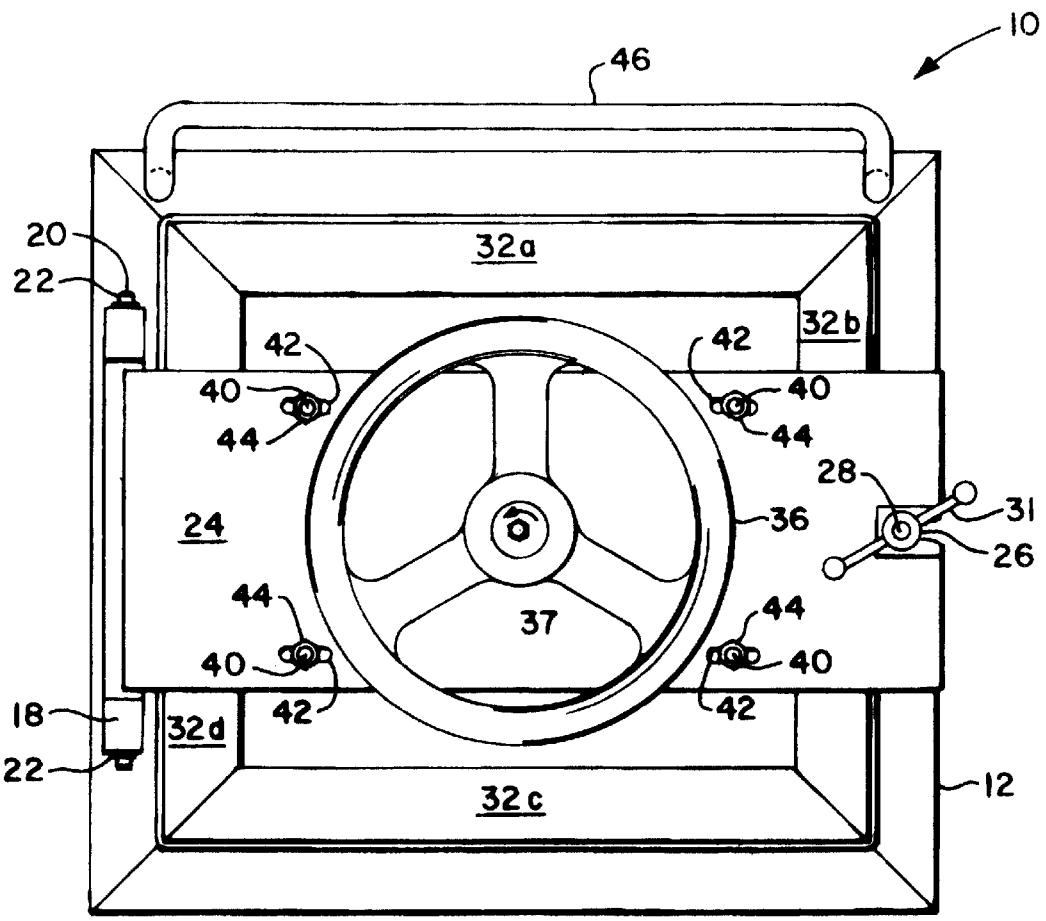
FIG. 1 is a front elevational view of the preferred embodiment of the access door in accordance with the present invention.
Figure 3:
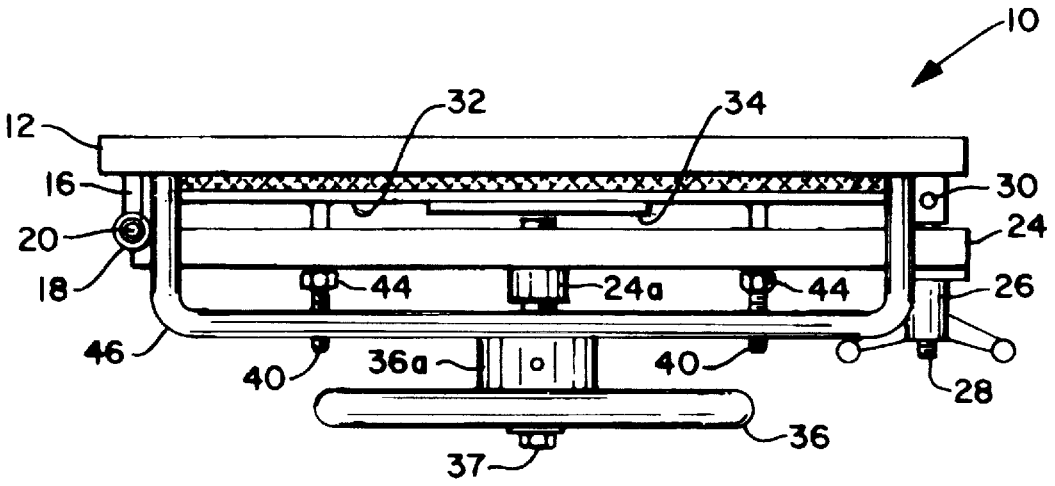
FIG. 3 is a plan view of the apparatus shown in FIGS. 1 and 2.

Referring now to FIGS. 1, 2 and 3 there is shown a preferred embodiment of the furnace access door assembly 10 in accordance with the invention. The access door assembly 10 includes a frame 12 that is manufactured from off-the-shelf channels having a generally U-shape. Carried on the frame 12 is a hinge 18 that includes a hinge pin 20 that is secured in place at the axial extremities thereof by respective C-clips 22.

Welded to the movable portion of the hinge 18 is a support plate 24. When the support plate 24 is disposed in blocking relationship to the doorway defined by the frame 12, a bolt 28 in combination with a wing nut 26 secures the support plate 24 so that it cannot move away from the frame 12. As best seen in FIG. 3, the bolt 28 is mounted on the frame 12 for pivotal motion about a pin 30. Thus, the bolt 28 with the wing nut 26 attached thereto is movable from the position shown in FIG. 1 and FIG. 3 to a position spaced away from the recess 31 in the support plate 24. It will be understood that when the bolt 28 and wing nut 26 are disengaged from the recess 31 in the support plate 24, the support plate 24 is free to pivot about the hinge pin 20 away from the frame 12.

The support plate 24 includes four elongated holes 42. The holes 42 are each dimensioned and configured for loose fitting engagement with one of four studs 40 that are welded to a generally planar reinforcement plate 34 that is welded to a door plate 32. The door plate 32 is generally planar and has one side thereof disposed in abutting relationship to the frame 12 when the door plate 32 is in the "closed position." The reinforcement plate 34 is disposed in face to face abutting relationship to the door plate 32.

Disposed on each of the four studs 40 is a nut 44 that provides some general constraint on the relative positions of the support plate 24 and the door plate 32. As best seen in FIG. 2 this constraint allows considerable latitude. The loose fit between the studs 40 and the elongated holes 42 ensures that the door plate 32 may move sufficiently to align perfectly with the frame 12. The door plate 32 is provided with a "picture frame" shaped channel reinforcement. The channels are respectively identified by reference numerals 32*a*, 32*b*, 32*c*, and 32*d*. It will be seen that these channels increase the rigidity of the door plate 32. As shown in the drawing, the flanges of the channels abut the plate 32 in the preferred embodiment. In other forms of the invention the web of one or more of the channels is welded to the plate 32.

The support plate 24 includes a sleeve 24*a* having internal threads that engage a threaded column 47. Fixed to the left (as viewed) axial extremity of the column 47 is a wheel 36 having a boss thereon for engagement with the column 47. A bolt 37 secures the wheel 36 to the column 47.

In operation, the door plate 32 is moved into generally abutting relationship with the frame 12. The bolt 28 and wing nut 26 are moved to the position shown in FIGS. 1 and 3. The wing nut 26 is tightened against the sides of the recess 31 in the support plate 24. Thereafter, the wheel 36 is rotated to advance the column 47 within the sleeve 24*a*. This causes the right (as viewed) axial extremity of the column 47 to push against the reinforcement plate 34 that is welded to the door plate 32. The support plate 24 cannot move away from the frame 12 because of the wing nut 26. Thus, the advancing column 47 presses against the reinforcement plate to force the door plate 32 against the gasket 70 in the frame 12.

Figure 11:
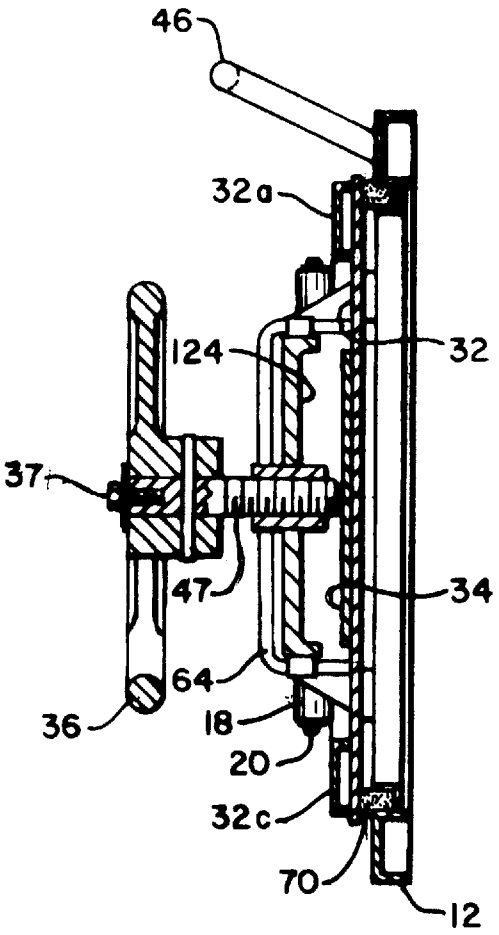
FIGS. 10 and 11 are respectively front and side elevational views similar to FIGS. 1 and 2 that illustrate further details of another embodiment of the invention.
Figure 10:
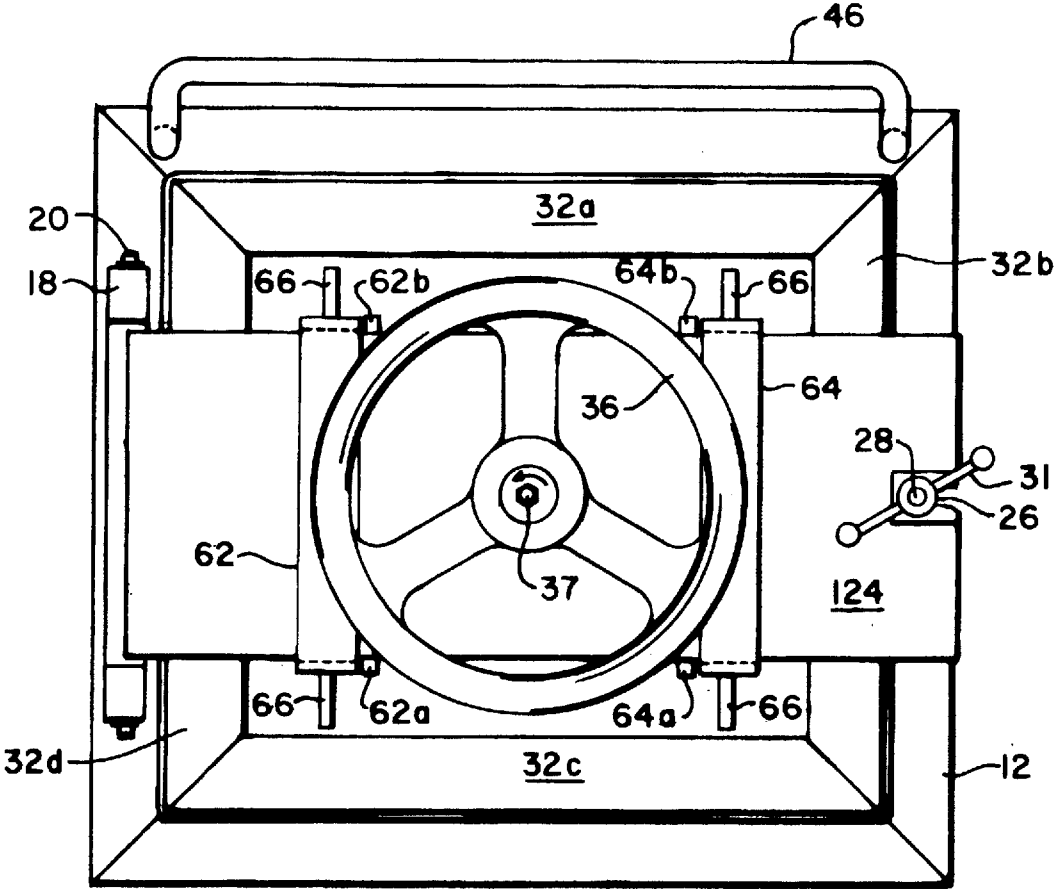

Referring now to FIGS. 10 and 11 there is shown another embodiment of the apparatus in accordance with the invention. This structure is substantially the same as the embodiment of FIGS. 1, 2 and 3 except for the manner in which the support plate is joined to the door plate 32. More specifically, the support plate is identified by the numeral 124. This support plate 124 has no holes 42 and there are no studs 40. Instead, straps 62,64 are wrapped around the support plate 124 as best seen in FIG. 11. It will be understood that the straps 62,64 each having a generally U-shape. The straps 62,64 include nubbins 62*a*, 62*b* and 64*a* and 64*b* that provide some constraint on the relative movement of the straps 62,64 and the support plate 124. Webs 66 extend from the axial extremity of each of the straps 62,64.

It will be seen that as the wheel 36 is rotated the column 47 advances against the reinforcement plate 34 to push the door plate 32 against the frame 12. The straps 62,64 prevent movement of the support plate 124 past the outer extent of the U-shape straps 62,64. Accordingly, the door plate 32 is forced against the frame 12. As in the embodiment of FIGS. 1, 2 and 3 there is a gasket 70 at the interface between the frame 12 and the door plate 32.

The furnace wall surface temperature during operation of the boiler depends on the specific part of the boiler in which the access door is located. Because the temperatures at all locations on the boiler are relatively high, it is advantageous to provide several different constructions respectively designed to meet the specific temperature conditions where the door will be installed. Thus, the present invention has specific constructions for locations where the boiler surface temperature is below 1250 degrees Fahrenheit (low temperature conditions), 1251 to 1900 degrees Fahrenheit (intermediate conditions) and 1901 degrees to 2500 degrees Fahrenheit (high temperature conditions).

Figure 4:
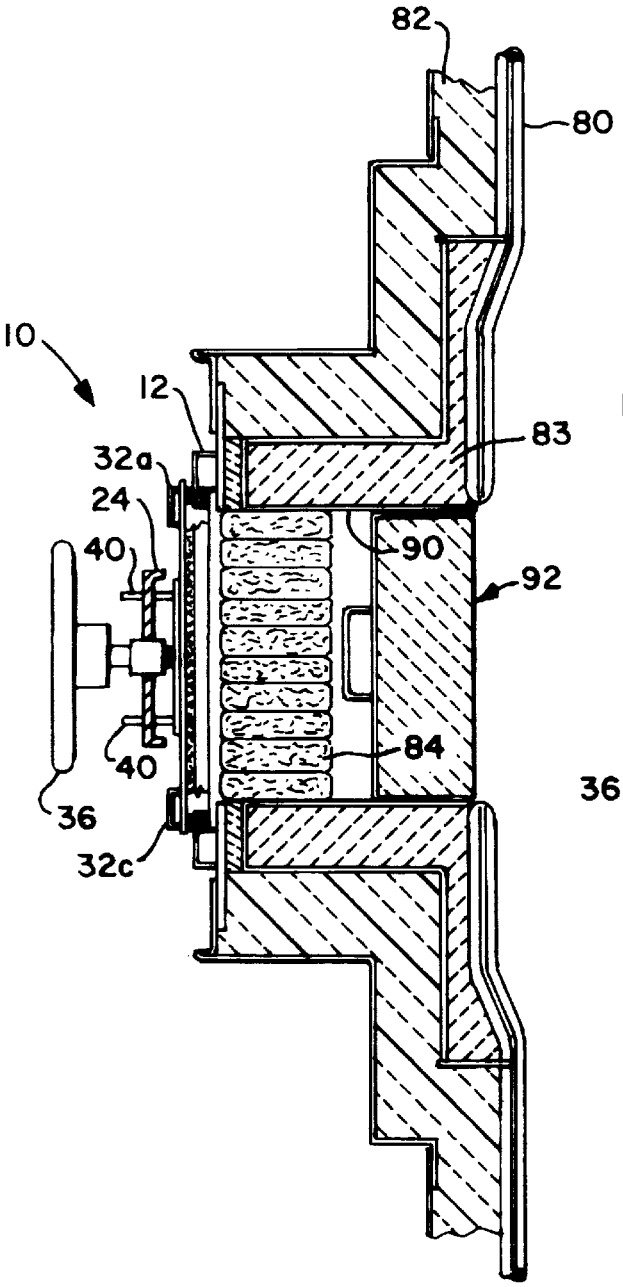
FIG. 4 is a partially sectional view taken along a horizontal plane through an embodiment of the apparatus intended for high temperature applications.

Referring now to FIG. 4 there is shown a high temperature configuration for use with either the door assembly shown in FIGS. 1–3 or the assembly shown in FIGS. 10–11. The walls of the boiler includes tubes 80 and insulation 82 held in place by lagging. A refractory 83 is disposed in the furnace wall setting. A ceramic fiber blanket 84 is disposed in the opening immediately behind the door assembly 10. Typically the ceramic fiber blanket will be tied together prior to installation in the opening. After installation the tying members will burn away and the blanket will expand to fill the entire opening as shown in FIG.4.

Figure 7:
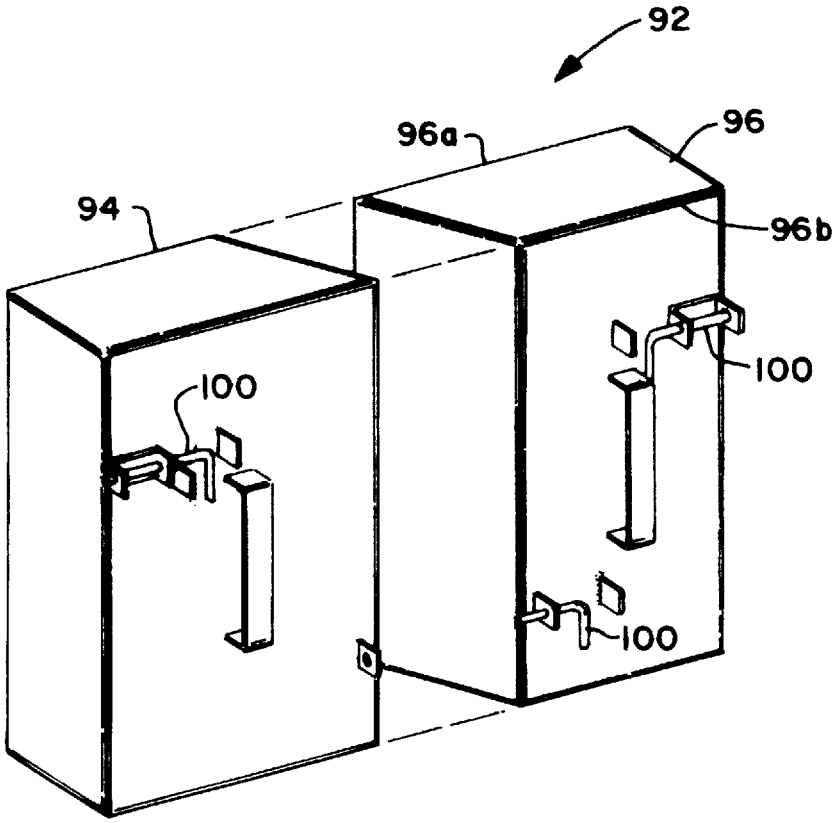
FIG. 7 is a perspective view of a preferred form of a two piece plug that is inserted in the access door opening in the boiler in place of refractory bricks.

Disposed further into the recess 90 is a removable plug 92. The removable plug 92 is shown in greater detail in FIG. 7. In the preferred form of the invention the removable plug 92, comprises two modules 94,96. The module 96 is tapered such that a cross-section through a horizontal plane, as well as the top surface thereof is a quadrilateral having two opposed sides 96*a*, and 96*b* that are parallel. In other words a cross-section through a horizontal plane, as well as the top surface thereof is a trapezium.

The tapered modules 96,94 permit a snug fit between the plug 92 and the walls defining the recess 90 of the boiler. L-shaped pins 100 are provided to secure the modules 94,96 to each other and to the walls defining the recess 90 of the boiler.

Although the plug 92 will be preferred by most operators it will be understood that bricks 102 and plastic insulation 94 may be preferred by some operators.

Figure 9:
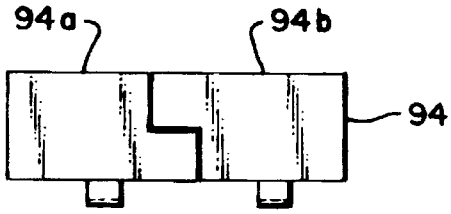
FIG. 9 is an alternative geometric configuration for a two piece plug construction.

An alternative embodiment of the invention incorporates a plug 94 that may be used instead of the plug 92. This plug 94 is shown in FIG. 9. The plug includes a stairstep interface between the modules 94*a* and 94*b*.

Figure 5:
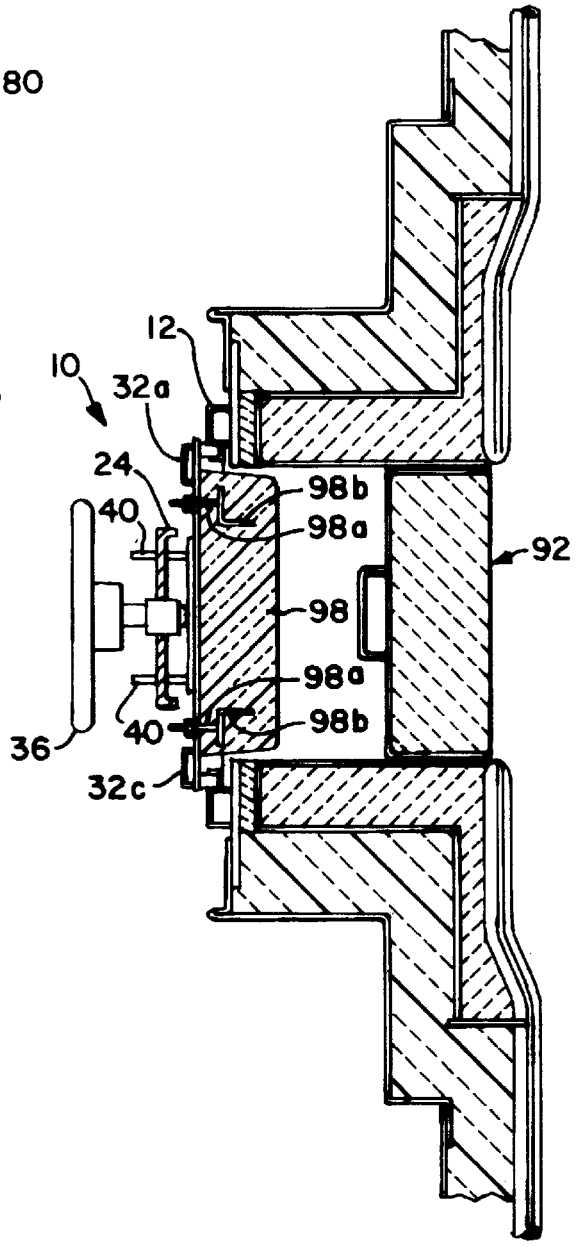
FIG. 5 is a partially sectional view similar to FIG. 4 and illustrating a construction which is suitable for intermediate and low temperature applications.

Referring now to FIG. 5 there is shown a cross section elevational view of an embodiment of the invention for intermediate and low temperature applications. The difference in construction between what will be used in an intermediate temperature location and in a low temperature location is only in the material used in the precast liner 98. The precast liner 98 is provided with four studs 98*a* that are supported within the precast refractory material of the liner 98 by a refractory anchor.

Figure 6A:
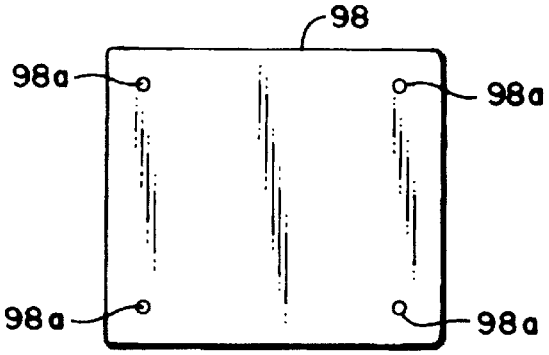
FIG. 6A is an elevational view of a pre-cast liner intended for installation on the rear of the access door and which has application for intermediate temperature installations.
Figure 6B:
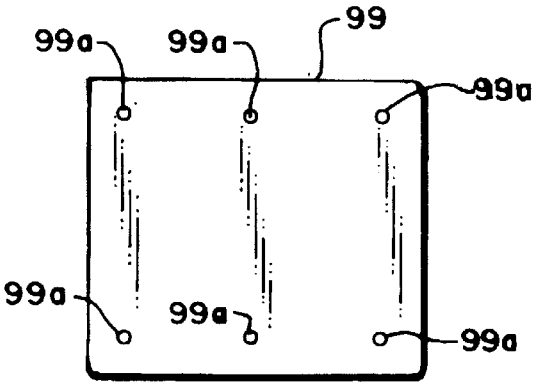
FIG. 6B is a view similar to the view in FIG. 6A illustrating a construction for relatively low temperature applications.
Figure 8:
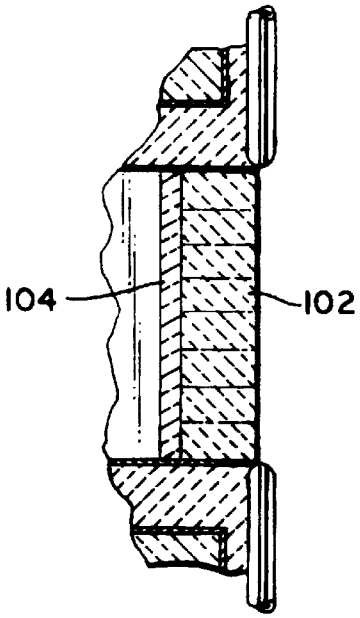
FIG. 8 is a sectional elevational viewing illustrating refractory bricks that may be used with the present invention if an operator so desires.

A liner 99, shown in FIG. 6B is intended for low temperature applications. This liner is provided with six studs 99*a* in contrast to the four studs 98*a* illustrated in FIG. 6A. The door plate 32 intended for low temperature applications will have six holes dimensioned and configured for engagement with the six studs 99*a* shown in FIG. 6B. It will be understood that if an operator wishes to install a low temperature grade liner 98 in an application where the door plate 32 is drilled with only four holes there will be an interference.

Conversely, for intermediate temperature applications the door plate 32 will be provided with holes dimensioned and configured for engagement with the four studs 98*a* of the intermediate temperature liner 98 shown in FIG. 6A. Thus, the low temperature rated liner 99 shown in FIG. 6B may not be installed inadvertently in an intermediate temperature location.

The apparatus of the present invention avoids the time and inconvenience considerations inherent in the use of refractory bricks and in situ cured insulation. It will also be seen that the present invention allows rapid retrofit of earlier door constructions, allows rapid replacement of door liners, provides better sealing than prior art door constructions, and allows for variations in construction that are required to function at various temperatures.

The invention has been described with reference to the illustrated preferred embodiment. Persons skilled in the art of such devices may upon disclosure of the teachings herein, conceive other variations. Such variations are deemed to be encompassed by the disclosure, the invention being delimited only by the following claims.

Having thus described our invention, we claim:

1. Apparatus for selectively permitting access through an opening extending from the exterior to the interior of an associated boiler and selectively closing off access to the interior of the associated boiler through the opening which comprises:

a frame;

a support plate;

a hinge, said hinge coupling said support plate and said frame and allowing pivotal movement of said support plate with respect to said frame;

a door plate; and means for coupling said support plate to said door plate, said means for coupling comprises a plurality of studs fixed to one of said plates in generally parallel spaced relationship, the other of said plates includes a plurality of holes disposed in generally registered relationship to said studs, said holes are dimensioned for loose fitting engagement with said studs, said apparatus further including means for latching said support plate to said frame to prevent pivotal movement thereof with respect to said frame and means for urging said door plate away from said support plate toward said frame, said means for urging said door plate away from said support plate includes a threaded member and a wheel fixed to said threaded member and said support plate includes a threaded sleeve dimensioned and configured for engaging said threaded member whereby rotation of said threaded member moves said threaded member with respect to said door plate, said threaded member having an axis and said axis is disposed in substantially perpendicular relationship to said door plate and said support plate, said means for coupling comprises first and second straps each fixed to said door plate and extending around said support plate, said straps constraining relative movement of said support plate with respect to said door plate, and each of said straps include nubbins extending therefrom for constraining movement of of said straps and said support plate.

2. Apparatus as described in claim 1 further including:

a cast plug shaped body dimensioned and configured for insertion and removal from an axial part of the opening that is axially spaced from said door plate;

said plug having a handle thereon to facilitate insertion and removal from said opening.

3. The apparatus as described in claim 2 wherein:

said plug is modular and comprises a first module and a second module, said modules being dimensioned and configured for snug fitting engagement in said opening.

4. The apparatus as described in claim 3 wherein:

each of said modules has a cross section that is a trapezium.

5. The apparatus as described in claim 4 wherein:

each of said modules has a generally stair step cross section.

* * * * *